US005761978A

United States Patent [19]

Nordlof

[11] Patent Number: 5,761,978

[45] Date of Patent: Jun. 9, 1998

[54] ROLL TYPE STOCK FEED APPARATUS WITH MECHANICAL FEED ROLL RELEASE

[75] Inventor: Richard D. Nordlof, Rockford, Ill.

[73] Assignee: Mechanical Tool & Engineering Co., Rockford, Ill.

[21] Appl. No.: 295,427

[22] Filed: Aug. 25, 1994

[51] Int. Cl.[6] ..... B26D 5/20

[52] U.S. Cl. ..... 83/259; 83/222; 83/225

[58] Field of Search ..... 83/261, 260, 259, 83/222, 225, 436, 422; 271/273, 271, 274; 198/602, 624

[56] References Cited

U.S. PATENT DOCUMENTS

| | | | |
|---|---|---|---|
| 2,261,703 | 11/1941 | Tetzlaff | 83/261 X |
| 2,339,962 | 1/1944 | Louis | 83/261 X |
| 2,726,083 | 12/1955 | Lewis, III | 271/274 X |
| 2,963,931 | 12/1960 | Lamoureux | 83/225 X |
| 3,067,999 | 12/1962 | Skeen . | |
| 3,246,822 | 4/1966 | Skeen | 271/273 X |
| 3,277,856 | 10/1966 | Ricci . | |
| 3,530,753 | 9/1970 | Imai | 83/436 |
| 4,294,170 | 10/1981 | Takahashi | 83/436 X |
| 4,942,796 | 7/1990 | Dom et al. | 83/259 X |
| 5,033,342 | 7/1991 | Nordlof . | |

*Primary Examiner*—Maurina T. Rachuba
*Attorney, Agent, or Firm*—Vernon J. Pillote

[57] ABSTRACT

A roll type stock feed apparatus having one feed roll rotatably mounted on a stationary frame structure, and a second feed roll mounted on a movable roll carrier and yieldably urged into a stock engaging condition. An electro-responsive servomotor is drivingly connected to at least one of the feed rolls for driving the feed rolls through a preselected feed cycle. An elongated ram position sensor is slidably mounted on the stationary frame structure for lengthwise reciprocation along an upright path and is yieldably urged upwardly relative to the frame structure to a preset raised position on the frame structure. A cam on the ram position sensor member engages a cam follower on the movable roll carrier and is operative in response to movement of the sensor member downwardly from the preset raised position to move the roll carrier and the second stock feed roll to a stock release condition.

7 Claims, 2 Drawing Sheets

ROLL TYPE STOCK FEED APPARATUS WITH MECHANICAL FEED ROLL RELEASE

BACKGROUND OF THE INVENTION

Some punch and die sets for punch presses, for example progressive type punch and dies, punch one or more pilot holes in the stock at one station and have pilot pins adapted to enter the pilot holes at a subsequent die station, for final positioning of the stock during each press cycle. Roll type stock feed apparatus have heretofore been made which are operative during each press cycle to drive the feed rolls and advance the stock in a selected increment, to release the feed rolls from the stock prior to entrance of the pilot pins into the pilot holes, and to reapply the feed rolls prior to initiating the subsequent drive cycle. U.S. Pat. No. 5,033,342 discloses a roll type stock feed apparatus having fluid actuators for releasing and applying fluid pressure on the feed rolls and a valve apparatus actuated by the press ram for reversibly supplying fluid pressure to the fluid pressure actuator. U.S. Pat. Nos. 3,067,999 and 3,277,856 disclose roll type stock feed mechanisms having a pivotally mounted upper roll carrier, and in which the upper feed roll is moved to a release condition by an actuator bar carried by the press ram. The actuator bar has a cam intermediate its ends for engaging a part on the upper roll carrier to move the feed roll to a stock release condition during the downward stroke of the ram. The stroke of the ram varies widely in different presses, for example, from a few inches to a foot or more, and it is generally desirable to actuate the feed roll to a release condition only during the lower portion of the ram stroke beginning prior to entrance of the pilot pins into the pilot holes and ending when the pilot pins have been withdrawn from the pilot holes, to maximize the remaining portion of the ram cycle that is available for feeding the stock. When the actuator bar is mounted for vertical reciprocation with the ram, the timing of the feed roll release during the ram cycle is dependent primarily on the vertical position of the actuator bar on the ram, but even small changes in horizontal position of the actuator bar relative to the roll carrier on the stock feed can significantly affect the ram position at which the cam on the actuator bar operates to effect feed roll release.

SUMMARY OF THE INVENTION

It is an object of the present invention to provide a roll type stock feed apparatus having an improved mechanical feed roll release adapted for actuation by the press ram which is easy to install and adjust to effect feed roll release during the desired portion of the ram cycle, and which minimizes the likelihood of damage to the press or feed apparatus in the event of misadjustment of the actuator on the ram.

Accordingly, the present invention provides a roll type stock feed apparatus having a first feed roll rotatably mounted on a stationary frame and a second feed roll mounted on a movable roll carrier and yieldably urged into stock engaging condition. An electro-responsive servomotor means is drivingly connected to at least one of the feed rolls for driving the feed rolls through a preselected feed cycle. An elongated ram position sensor member is slidably mounted on the stationary frame for lengthwise reciprocation along an upright path and is yieldably urged upwardly relative to the frame. Stop means stops upward movement of the sensor member when the latter is in a preset raised position on the frame structure. Roll carrier actuating means including first and second interengaging cam means operate in response to movement of the ram position sensor member downwardly from the preset raised position to move the movable roll carrier and the second feed roll to a stock release condition.

In a preferred embodiment, the inter-engaging cam means comprises cam surfaces on the ram position sensor member and cam follower means engageable with the cam surfaces on the sensor member. The cam surfaces are advantageously arranged to progressively move the second feed roll from the stock engaging position toward the stock release position as the sensor member is moved a first distance downwardly from the preset raised position, and to stop further movement of the second feed roll when the sensor member is moved downwardly beyond the first distance, to allow the sensor member to over travel and prevent damage to the feed apparatus in the event the actuator is improperly adjusted on the ram.

DETAILED DESCRIPTION

Figure 1:
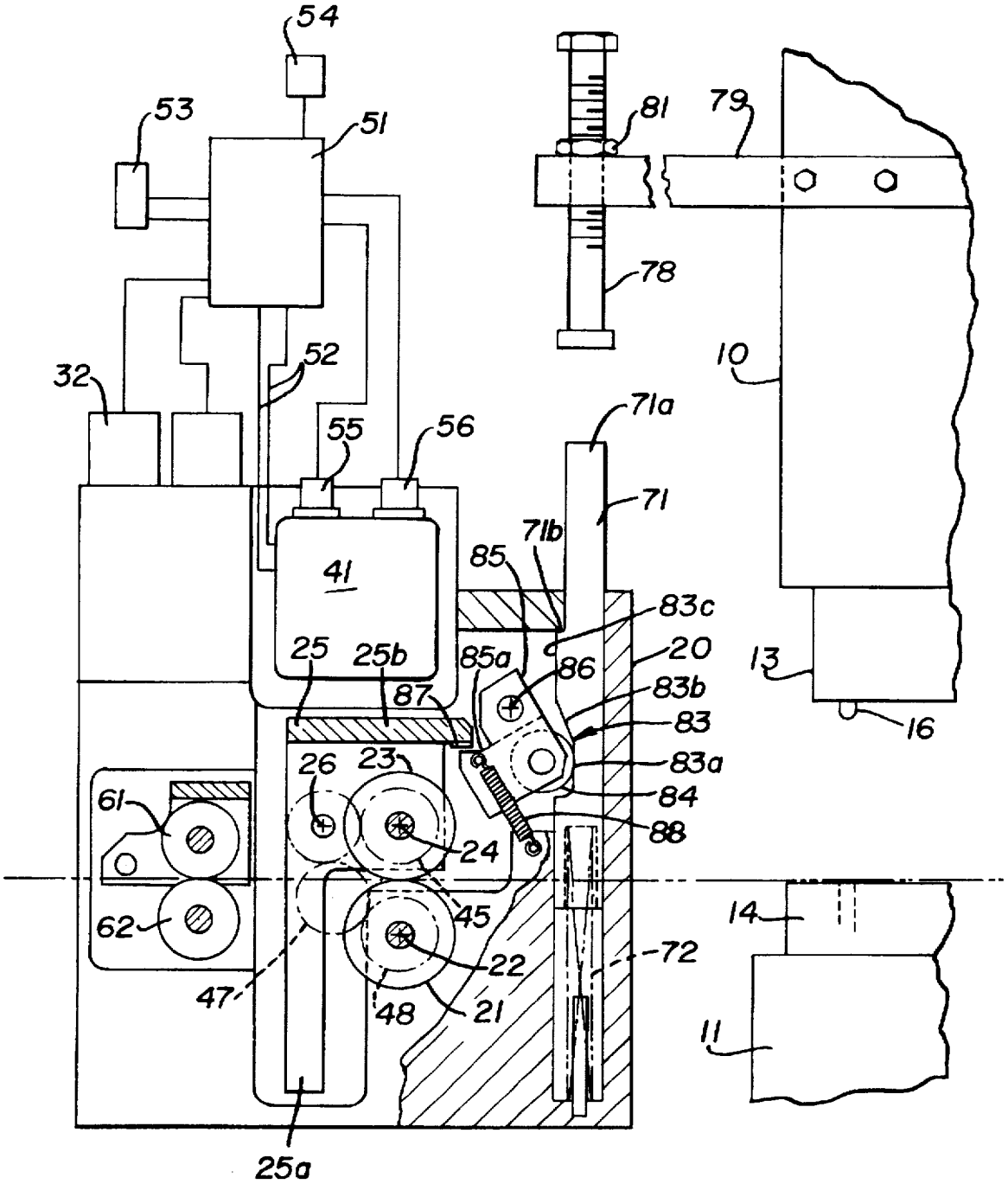
FIG. 1 is a view illustrating the feed apparatus partially in section and partially diagrammatically, with the press ram in a raised position.

The roll type stock feed apparatus of the present invention is adapted to intermittently advance strips of stock in each operating cycle of a power press, diagrammatically illustrated in FIG. 1 as having a ram 10, a base 11 and punch and die means 13 and 14 on the ram and base respectively. The feed apparatus is arranged to release feed pressure on the stock feed rolls during a portion of each press cycle so that a pilot pin or pins indicated at 16 on the press dies 13 can enter the pilot holes in the strip stock to position the same before the forming operation, and to thereafter reapply pressure to the stock feed rolls after the forming operation and before the stock feed rolls are driven to advance a further length of stock.

Figure 3:
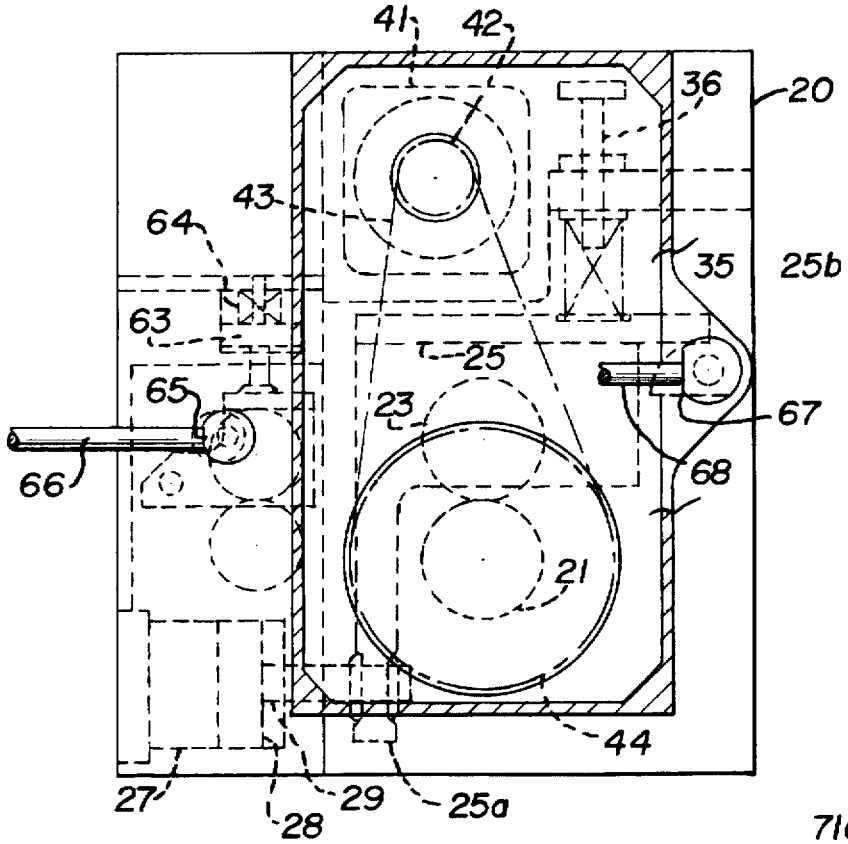
FIG. 3 is a longitudinal sectional view of the feed apparatus on a different plane than FIG. 1.
Figure 2:
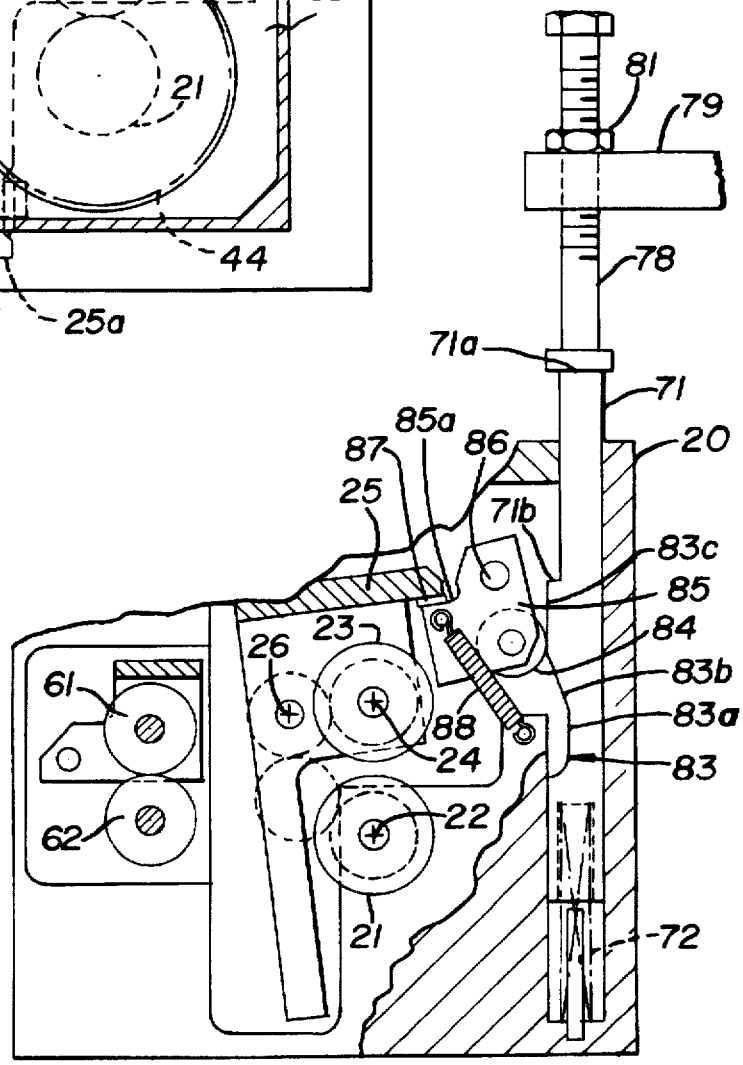
FIG. 2 is a fragmentary view similar to FIG. 1 and illustrating the ram in a lower position.

The roll type stock feed apparatus has a rigid stationary frame structure designated generally by the numeral 20. A first stock feed roll 21 is mounted on the stationary frame structure for rotation about an axis 22 and a second stock feed roll 23 is mounted for rotation about an axis 24 on a movable roll carrier 25. The movable roll carrier 25 is mounted for pivotal movement about an axis 26 on the frame structure to allow movement between a feed condition as shown in FIG. 1 and a release condition as shown in FIG. 2. The movable roll carrier 25 is yieldably biased in a direction to press the second stock feed roll 23 into feeding engagement with the stock between the first and second feed rolls 21, 23. As shown in FIG. 3, a piston 28 has a rod 29 connected to an arm **25*a* on the movable roll carrier 25. The piston is slidably disposed in a cylinder 27 formed in the frame structure and air under a preferably selectively adjustable pressure is supplied to the rod end of the piston under the control of a valve 32 (FIG. 1). The roll carrier can also be mechanically biased as by springs 35 (FIG. 3) interposed between a second arm 25*b* on the roll carrier 25 and a part on the stationary frame, and the spring pressure is preferably made adjustable by an adjusting screw 36**.

The feed rolls are driven through a selectively adjustable angle to advance strip stock a selected distance by a servomotor 41. As shown in FIG. 3, the servomotor 41 has an output pulley 42 connected through a toothed belt 43 to a pulley 44 drivingly connected to one of the feed rolls 21. The second stock feed roll is also advantageously driven and, diagrammatically shown in FIG. 1, a gear 45, drivingly connected to the second stock feed roll 23, meshes with a gear 46 rotatable about the pivot axis 26 of the movable roll carrier 25, and an idler gear 47 is disposed in driving engagement with gear 46 and with a gear 48 that rotates with the first stock feed roll 21. With this arrangement, the gears 45–48 are selected so as to drive the second stock feed roll 23 at the same peripheral speed as the first stock feed roll 21, but in a relatively opposite direction, and to accommodate limited movement of the second stock feed roll relative to the first stock feed roll.

Servomotor type drives are well known and, as diagrammatically illustrated in FIG. 1, a programmable controller 51 is connected through a buss 52 to a servomotor type roll drive motor 41. Feed command signals from an operator interface 53 are supplied to the programmable controller and signals correlative with the press crank shaft position are applied to the programmable controller from a rotary resolver or encoder 54, conveniently driven from the press crank shaft. As is conventional, the servomotor 41 has a tachometer 55 and motor shaft encoder 56 connected to the servomotor to provide feedback signals correlative with the speed and rotational position of the feed rolls. The operator interface 53 is arranged to provide command signals representative of the desired stock feed length and the angular positions of the press crank at which stock feed is to start and stop. The controller 51 is preprogrammed to set the acceleration, speed and deceleration rates for the servomotor.

As is conventional, upper and lower anti-backup rolls 61, 62 are provided and a one-way clutch (not shown) is arranged to allow rotation of one of the anti-backup rolls in the direction of forward stock feed while preventing reverse rotation. As diagrammatically illustrated in FIG. 3, the upper anti-backup roll 61 is biased into stock engaging position by a piston 63 or by a spring 64. A cam 65, manually operable by a lever 66, is provided for moving the upper anti-backup roll to a release condition and, similarly, a cam 67, manually operable by a lever 68, is provided for moving the second stock feed roll to a release condition to facilitate threading the stock through the feed rolls and anti-backup rolls on start-up.

A mechanical pilot release is provided for lifting the upper feed rolls in timed relation with the operation of the press ram, to release the second stock feed roll from feeding engagement with the stock prior to the pilot pin 16 entering the pilot openings in the stock, and for moving the second feed roll back into feeding engagement with the stock prior to operation of the servomotor through a stock feed cycle. In accordance with the present invention, an elongated ram position sensor member 71 is slidably mounted on the stationary frame structure 20 for lengthwise reciprocation along an upright path paralleling the path of reciprocation of the ram 10. The ram position sensor member is yieldably urged to a raised position by a spring 72 and a stop means is provided for stopping upward movement of the sensor member when the latter is in a preset raised position shown in FIG. 1. The spring 72 is preferably a coil type spring having a lengthwise axis paralleling the path of movement of the sensor member. An upper end of the spring is disposed in a blind bore in the lower end of the sensor member and the lower end of the spring is guided by a guide pin fixed to the stationary support structure and disposed inside the lower end of the spring. As shown in FIG. 1, the stop means includes an upwardly facing shoulder **71*b* on the ram position sensor member that is engageable with a downwardly facing abutment on the stationary frame structure when the sensor member reaches the preset raised position shown in FIG. 1. The ram position sensor member 71 has an upwardly facing head 71*a* adapted for engagement by an actuator 78 mounted by a bracket 79 on the press ram 10 for reciprocation therewith. Actuator 78 is adjustable relative to the ram and, as shown, may conveniently comprise a bolt or rod threaded in the bracket 79 and which is adapted to be locked in adjusted position as by a nut 81. The actuator 78 moves with the ram during a major portion of the ram stroke and is adjusted to engage the head 71*a* on the ram position sensor member 71** as a ram approaches the bottom dead center position of the press crank and just prior to the ram position at which the pilot pins on the upper die set enter pilot holes in the strip stock. After the actuator engages the ram position sensor member, it depresses the sensor member while the ram crank moves through and past bottom dead center position, and then disengages the sensor member during the remaining upward travel of the ram.

Roll carrier actuating means are provided for moving the upper roll carrier to release the stock in response to movement of the ram position sensor member downwardly from its preset raised position. The roll carrier actuating means includes first and second inter-engaging cam means 83 and 84 configured to move the second stock feed roll from the stock engaging condition toward the stock release condition as the ram position sensor member is moved a first distance downwardly from the preset raised position, and to interrupt further movement of the second stock feed roll when the ram position sensor member is moved downwardly beyond the first distance, to allow over travel of the ram position sensor member in the event the actuator 78 is misadjusted on the ram and engages a ram position sensor member too early in the downward stroke of the ram. In the preferred embodiment illustrated, the first cam means 83 comprises a cam on the ram position sensor member and the second cam means 84 comprises a follower that engages the cam on the ram position sensor member. In order to improve the direction of the lifting force applied to the movable roll carrier 25 by the cam arrangement illustrated, the cam follower 84 is mounted on a bell crank lever 85 that is pivoted on the frame structure for movement about an axis 86. The bell crank lever has a nose portion **85*a* engageable with a wear plate 87 on the arm 25*b* of the movable roll carrier and the bell crank lever is yieldably urged in a counterclockwise direction as viewed in FIGS. 1 and 2 by a coil type tension spring 88 terminally attached to the bell crank lever and the stationary frame structure so that the cam follower 84 is normally disposed in engagement with cam 83. The cam 83 includes a first cam surface 83*a* arranged to engage the cam follower 84 when the sensor member is in its preset raised position. When the follower 84 is in engagement with the cam surface 83*a*, the nose 85*a* on the bell crank is out of engagement with the roll carrier so that full feed pressure can be applied to the upper feed roll. The cam surface has a second surface 83*b* that is inclined upwardly relative to the path of movement of the ram position sensor member 71 for engaging the cam follower as the ram position sensor member is moved downwardly from its raised position. Surface 83*b* is arranged to progressively move the movable roll carrier and hence the second feed roll toward a release condition. For very thin strip stock, the cam 83 will move the second feed roll to a release condition when the ram position sensor member is only a short distance from its fully raised condition, while for thicker stock, the cam 83 will commence moving the second feed roll toward a release condition only after the ram position sensor member has been moved downwardly a somewhat greater distance from the preset raised position. The length and angle of the cam surface 83***b* is selected so as to be sufficient to move the second feed roll to a released condition even with the thickest stock to be fed by the feed apparatus. The cam surface includes a further surface 83*c* that extends upwardly from the surface 83*b* generally parallel to the path of movement of the sensor member. The surface 83*c* limits the maximum opening of the second feed roll and allows over travel of the ram position sensor member to prevent damage in the event the actuator on the ram is improperly adjusted and engages the sensor member too far before the ram position at which the pilot pins enter the pilot holes in the stock. As will be seen, the portion of each press cycle that is available for advancing the stock can be maximized by adjusting the actuator 78 on the ram so that it depresses the ram position sensor member during each stroke an amount only sufficient to release the upper feed roll from the stock. As previously discussed, the sensor movement required for thin stock is less than that required for thicker stock and, by appropriate adjustment of the actuator 78, the portion of the ram cycle that is available for stock feed can be maximized for each different stock thickness. This, in turn, allows operation of the press at higher speeds for any given length of stock feed.

The embodiments of the invention in which an exclusive property or privilege is claimed are defined as follows:

1. A roll type stock feed apparatus for intermittently advancing strip stock to a power press having a ram vertically reciprocal through a ram cycle, the stock feed apparatus including a stationary frame structure, a first feed roll mounted on the stationary frame structure for rotation about a first roll axis, roll carrier means movably mounted on the stationary frame structure and a second feed roll mounted on the roll carrier means, the roll carrier means supporting the second feed roll for rotation about a second roll axis parallel to the first roll axis and for limited movement transverse to the second roll axis toward and away from the first feed roll, pressure applying means yieldably urging the roll carrier means in a first direction for pressing the second feed roll toward the first feed roll and into a stock engaging condition, electro-responsive servomotor means drivingly connected to at least one of the feed rolls and actuatable to drive the feed rolls through a preselected feed cycle, an elongated ram position sensor member slidably mounted on the stationary frame structure for lengthwise reciprocation along an upright path and having an upwardly facing abutment, an actuator mounted on the ram for reciprocation with the ram into and out of engagement with the upwardly facing abutment on the ram position sensor member during a portion of the ram cycle, means yieldably urging the ram position sensor member upwardly relative to the stationary frame structure and stop means for stopping upward movement of the ram position sensor member when the ram position sensor member is in a preset raised position on the stationary frame structure, roll carrier actuating means including first and second inter-engaging cam means operative in response to movement of the ram position sensor member downwardly from said preset raised position for moving the roll carrier means in a second direction opposite said first direction and in opposition to the pressure applying means to move the second feed roll to a stock release condition.

2. A roll type stock feed apparatus according to claim 1 wherein the first interengaging cam means comprises cam surfaces on the ram position sensor member and the second interengaging cam means comprises cam follower means engageable with the cam surfaces on the ram position sensor member.

3. A roll type stock feed apparatus according to claim 1 wherein the first and second interengaging cam means are configured to actuate the roll carrier means in said second direction and move the second feed roll from the stock engaging condition toward the stock release condition as the ram position sensor member is moved a first distance downwardly from said preset raised position and to interrupt further movement of the roll carrier means in said second direction when the ram position sensor member is moved downwardly beyond said first distance.

4. A roll type stock feed apparatus for intermittently advancing strip stock to a power press having a ram vertically reciprocal through a ram cycle and an actuator reciprocal with the ram along an actuator path, the stock feed apparatus including a stationary frame structure, a first feed roll mounted on the stationary frame structure for rotation about a first roll axis, roll carrier means movably mounted on the stationary frame structure and a second feed roll mounted on the roll carrier means, the roll carrier means supporting the second feed roll for rotation about a second roll axis parallel to the first roll axis and for limited movement transverse to the second roll axis toward and away from the first feed roll, pressure applying means yieldably urging the roll carrier means in a first direction for pressing the second feed roll toward the first feed roll and into a stock engaging condition, electro-responsive servomotor means drivingly connected to at least one of the feed rolls and actuatable to drive the feed rolls through a preselected feed cycle, roll lifter mechanism including an elongated ram position sensor member slidably mounted on the stationary frame structure for lengthwise reciprocation along an upright path and having an upwardly facing abutment positioned in said actuator path for engagement by the actuator on the ram during a portion of the ram cycle, means yieldably urging the ram position sensor member upwardly relative to the stationary frame structure and stop means for stopping upward movement of the ram position sensor member when the ram position sensor member is in a preset raised position on the stationary frame structure, the ram position sensor member having cam means, the roll lifter mechanism also including roll carrier actuating means having cam follower means engaging the cam means on the ram sensor member and responsive to movement of the ram position sensor member downwardly from said preset raised position for moving the roll carrier means in a second direction opposite said first direction and in opposition to the pressure applying means to move the second feed roll to a stock release condition.

5. A roll type stock feed apparatus according to claim 4 wherein the cam means on the ram position sensor member is configured to actuate the roll carrier means in said second direction and move the second feed roll from the stock engaging condition toward the stock release condition as the ram position sensor member is moved downwardly a first distance from said preset raised position and to interrupt further movement of the roll carrier means in said second direction when the ram position sensor member is moved downwardly beyond said first distance.

6. A roll type stock feed apparatus according to claim 4 wherein said cam means has a first cam surface contiguous to said cam follower means when the ram position sensor member is in said preset raised position and a second cam surface extending from an upper end of said first cam surface and inclined relative to said upright path for engaging the cam follower means as the ram position sensor member is moved downwardly from said preset raised position and a third cam surface extending upwardly from an upper end of the second cam surface and generally paralleling said upright path.

7. A roll type stock feed apparatus for intermittently advancing strip stock to a power press having a ram vertically reciprocal through a ram cycle and an actuator reciprocal along an actuator path with the ram, the stock feed apparatus including a stationary frame structure, a first feed roll mounted on the stationary frame structure for rotation about a first roll axis, roll carrier means movably mounted on the stationary frame structure and a second feed roll mounted on the roll carrier means, the roll carrier means supporting the second feed roll for rotation about a second roll axis parallel to the first roll axis and for limited movement transverse to the second roll axis toward and away from the first feed roll, pressure applying means yieldably urging the roll carrier means in a first direction for pressing the second feed roll toward the first feed roll and into a stock engaging condition, electro-responsive servomotor means drivingly connected to at least one of the feed rolls and actuatable to drive the feed rolls through a preselected feed cycle, roll lifter mechanism including an elongated ram position sensor member slidably mounted on the stationary frame structure for lengthwise reciprocation along an upright path and having an upwardly facing abutment positioned in the actuator path to be engaged by the actuator on the ram during a portion of the ram cycle, means yieldably urging the ram position sensor member upwardly relative to the stationary frame structure and stop means for stopping upward movement of the ram position sensor member when the ram position sensor member is in a preset raised position on the stationary frame structure, the ram position sensor member having cam means, the roll lifter mechanism also including roll carrier actuating means having cam follower means engaging the cam means on the ram position sensor member and responsive to movement of the ram position sensor member downwardly from said preset raised position for moving the roll carrier means in a second direction opposite said first direction and in opposition to the pressure applying means to move the second feed roll to a stock release condition, wherein the means yieldably urging the ram position sensor member upwardly includes an elongated coil compression spring having a lengthwise axis paralleling a path of reciprocation of the ram position sensor member, the sensor member having a cavity in a lower end guidably receiving an upper end of the compression spring, and the frame structure having means guidably engaging a lower end of the compression spring.

* * * * *